US006299753B1

(12) United States Patent
Chao et al.

(10) Patent No.: US 6,299,753 B1
(45) Date of Patent: Oct. 9, 2001

(54) DOUBLE PRESSURE VESSEL CHEMICAL DISPENSER UNIT

(75) Inventors: Sandy S. Chao, San Jose; Mark Lloyd, deceased, late of Fremont, both of CA (US), by Anna Marie Lloyd, legal representative

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/387,941

(22) Filed: Sep. 1, 1999

(51) Int. Cl.[7] ..... C25D 7/12; C25B 15/08

(52) U.S. Cl. ..... 205/157; 204/275.1; 204/237

(58) Field of Search ..... 204/242, 275.1, 204/277, 237; 222/52; 118/407, 429; 205/157

(56) References Cited

U.S. PATENT DOCUMENTS

| | | | | |
|---|---|---|---|---|
| 3,649,509 | | 3/1972 | Morawetz et al. | 204/238 |
| 4,111,761 | * | 9/1978 | LaBoda | 204/26 |
| 4,326,940 | | 4/1982 | Eckles et al. | 204/232 |
| 4,789,445 | | 12/1988 | Goffman et al. | 204/114 |
| 5,092,975 | | 3/1992 | Yamamura et al. | 204/198 |
| 5,148,945 | | 9/1992 | Geatz | 222/1 |
| 5,330,072 | | 7/1994 | Ferri, Jr. et al. | 222/1 |
| 5,447,615 | | 9/1995 | Ishida | 204/224 R |
| 5,516,412 | | 5/1996 | Andricacos et al. | 204/224 R |
| 5,722,447 | * | 3/1998 | Morgan et al. | 137/1 |
| 5,803,599 | | 9/1998 | Ferri, Jr. et al. | 366/134 |

OTHER PUBLICATIONS

PCT Written Opinion citing additional references for PCT/US 99/28159, dated Dec. 8, 2000.

* cited by examiner

*Primary Examiner*—Robert Dawson
*Assistant Examiner*—Michael J. Feely
(74) *Attorney, Agent, or Firm*—Thomason, Moser and Patterson, L.L.P.

(57) ABSTRACT

The present invention generally provides a fluid delivery system with particular application to electroplating. Two or more reservoirs are fluidly connected to one or more processing chambers by fluid delivery lines. A gas source is coupled to the reservoirs to selectively pressurize the reservoirs and cause fluid flow therefrom to the processing chambers through the fluid delivery lines. The fluid levels in the reservoirs and the processing chambers are controlled to facilitate avity-assisted flow of fluid from the processing chambers to the reservoirs via the fluid delivery line when the fluid levels in the processing chambers are higher than the fluid levels in the reservoirs. In operation, the reservoirs are alternately filled and emptied with a fluid circulated between the reservoirs and the processing chambers. Alternately filling and emptying the reservoirs relative to one another at constant rates maintains the fluid level and flow rate in the processing chamber substantially constant.

24 Claims, 4 Drawing Sheets

DOUBLE PRESSURE VESSEL CHEMICAL DISPENSER UNIT

BACKGROUND OF THE INVENTION 1. b Field of the Invention

The present invention relates to a fluid delivery system with particular application to an electroplating system.

2. Background of the Related Art

Semiconductor processing systems typically require fluid delivery apparatus to supply chemicals and other fluids to various components of the processing system. For example, electroplating involves the use of an electrolytic solution to plate a conductive surface formed on device features of a substrate. The substrate is positioned in a processing chamber, or cell, to expose a surface of the substrate to the electrolytic solution. The cell typically includes a cell body, an anode and a cathode on which the substrate is mounted. The solution is flowed into the cell and over the exposed surface of the substrate while a power supply biases the surface of the substrate with respect to the anode and solution to attract ions from the electrolytic solution, thereby plating the surface with a metal, such as copper. After flowing past the substrate, the fluid is emptied into a fluid source such as a tank or reservoir and then cycled back to the cell. In order to maintain a uniform chemical composition, the electrolytic solution is continuously circulated between the processing cells and the fluid source which also acts to replenish the chemical components of the electrolytic solution. Thus, a continuous supply of the electrolyte can be flowed past the substrate.

FIG. 1 is a simplified schematic of an electrolyte delivery system 10. A main tank 12 provides a bulk source of an electrolytic solution. The composition of the solution in the main tank 12 is controlled by a dosing module 14 which supplies the various constituents of the solution in the desired proportions. A supply line 16 couples the main tank 12 to processing cells 18 located downstream wherein substrates (not shown) are disposed during processing. A pump 17 disposed in the supply line 16 causes the solution to flow from the main tank 12 to the cells 18. The electrolytic solution is flowed through the cells 18 and subsequently expelled from the cells 18 via outlet lines 20. The outlet lines 20 dispense the electrolyte to an electrolyte return module (ERM) 22 which is fluidly coupled to the main tank 12 by a return line 24. A pump 26 disposed in the return line 24 pumps the spent electrolyte from the ERM 22 back to the main tank 12.

One problem with current fluid delivery systems, such as the system 10 shown in FIG. 1, is the use of pumps 17, 26 to circulate the fluid from the main tank 12 to the cells 18 and back to the main tank 12. Pumps 17, 26 are typically positive displacement pumps employing the use of diaphragms to provide lift at a suction inlet and pressure at an outlet. Such pumps require periodic maintenance or replacement as components, such as the diaphragm, become worn. Additionally, pump components, such as the diaphragm, are a source of contamination for the electrolyte as the components degrade over time. The resulting contamination can become lodged in device features formed on the substrate during processing and lead to defective devices. While filtration systems may be used to capture and remove larger particles from the electrolytic solution, some particles are too small for state-of-the-art filtration equipment. As the device geometry's continue to shrink the relative size of particles becomes larger.

Another problem with the use of pumps is the detrimental effect on the flow rate of the electrolyte over the surface of the substrate. In order to ensure uniform plating over a substrate surface at a constant rate, the flow rate of electrolytic solution in the cells must be maintained substantially constant during processing. However, the rapid action of pumps creates massive impulses in the system resulting in pulsed flow of the electrolyte in the cell. Thus, the flow pulses caused by the pumping action of the pumps causes the flow rate of solution in the cells to vacillate. Further, the pulsed flow can also force particles through filters disposed in the delivery system, thereby rendering the filters ineffective even for larger particles normally captured by the filters. Thus, the use of pumps in a fluid delivery system can present considerable cost in parts, labor, down-time and defective devices.

Therefore, there is a need for a fluid delivery system which eliminates or minimizes contamination of the fluid as well as flow pulses by use of components such as pumps.

SUMMARY OF THE INVENTION

The present invention generally relates to a fluid delivery system with particular application to an electroplating system.

In one aspect, the invention includes two or more reservoirs fluidly connected to one or more processing cells by a supply line and a return line. The upper fluid levels in the two or more reservoirs are maintained vertically displaced by a height from the processing cells to facilitate gravity-assisted flow of fluid from the processing cells to the reservoirs via the return line. A gas source is coupled to the reservoirs to selectively pressurize the reservoirs and cause fluid flow therefrom to the processing cells through the supply line. Valves disposed in the supply line and return line control the direction and rate of fluid flow and ensure equal flow rates into each cell. In a first position, the valves communicate the first reservoir and processing cell along the supply line and the second reservoir and the processing cell along the return line. In a second position, the valves communicate the first reservoir and processing cell along the return line and the second reservoir and the processing cell along the supply line. The reservoirs are alternately filled and emptied with a fluid circulated between the reservoirs and the processing cells.

In another aspect, a method of circulating a fluid between two or more reservoirs and a processing system is provided, wherein the lowest fluid level in the processing system is maintained at a level higher than the highest fluid level in the two or more reservoirs to provide a positive fluid pressure differential between the processing system and the pair of reservoirs. Pressurizing a first reservoir induces fluid flow from the first reservoir to the processing system. Fluid is flowed from the processing system to a second reservoir by gravity. Upon reaching a low fluid level in the first reservoir and a high fluid level in the second reservoir, the direction of fluid flow is reversed so that fluid is flowed from the second reservoir to the processing system and from the processing system to the first reservoir. Fluid flow from the second reservoir is induced by pressurizing the second reservoir. Fluid flow from the processing system to the first reservoir is provided by gravity. The flow rates to and from the processing system is preferably maintained substantially constant to allow for a uniform flow rate and constant fluid level in the processing system.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a fluid delivery system. While the following description refers to a fluid delivery system for an electroplating system, it should be understood that the invention contemplates application to other processing arrangements such as for a chemical mechanical polishing system which requires the delivery and recirculation of chemicals such as slurry.

In general, the invention includes two or more reservoirs fluidly connected to one or more processing chambers by a supply line and a return line. In operation, fluid flows in a loop from the processing chambers to the reservoirs by gravity flow, and from the reservoirs to the chambers under pressure (to overcome gravity). A gas source is coupled to the reservoirs to selectively pressurize the reservoirs and cause fluid flow therefrom to the processing chambers through the supply line. The fluid levels in the reservoirs and the processing chambers are controlled to facilitate gravity-assisted flow of fluid from the processing chambers to the reservoirs via the return line when the fluid levels in the processing chambers are higher than the fluid levels in the reservoirs. Valves disposed in the supply line and return line control the direction and rate of fluid flow. In operation, the reservoirs are alternately filled and emptied with a fluid circulated between the reservoirs and the processing chambers. The reservoirs are filled by communicating with the processing chambers and allowing fluid flow from the chambers due to gravity. The reservoirs are emptied, i.e., the fluid is flowed therefrom and to the processing chambers, by alternately pressurizing each reservoir using the gas source. Alternately filling and emptying the reservoirs relative to one another at constant rates enables maintenance of the flow rate in the processing chamber at a substantially constant value without the pressure and flow spikes induced by mechanical pumping.

Figure 1:
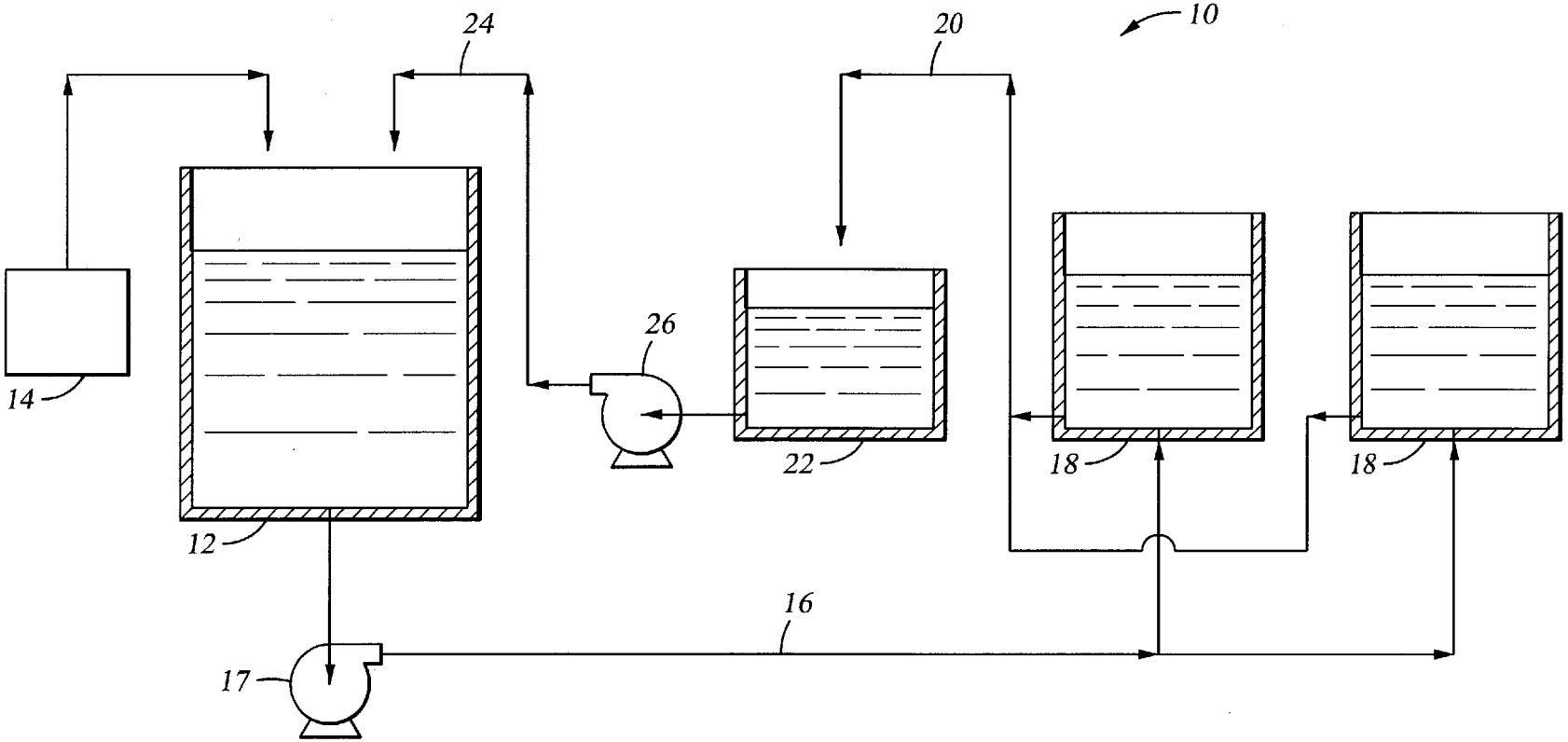
Fig. 1 (PRIOR ART)
FIG. 1 is a schematic representation of a prior art fluid delivery system.
Figure 2:
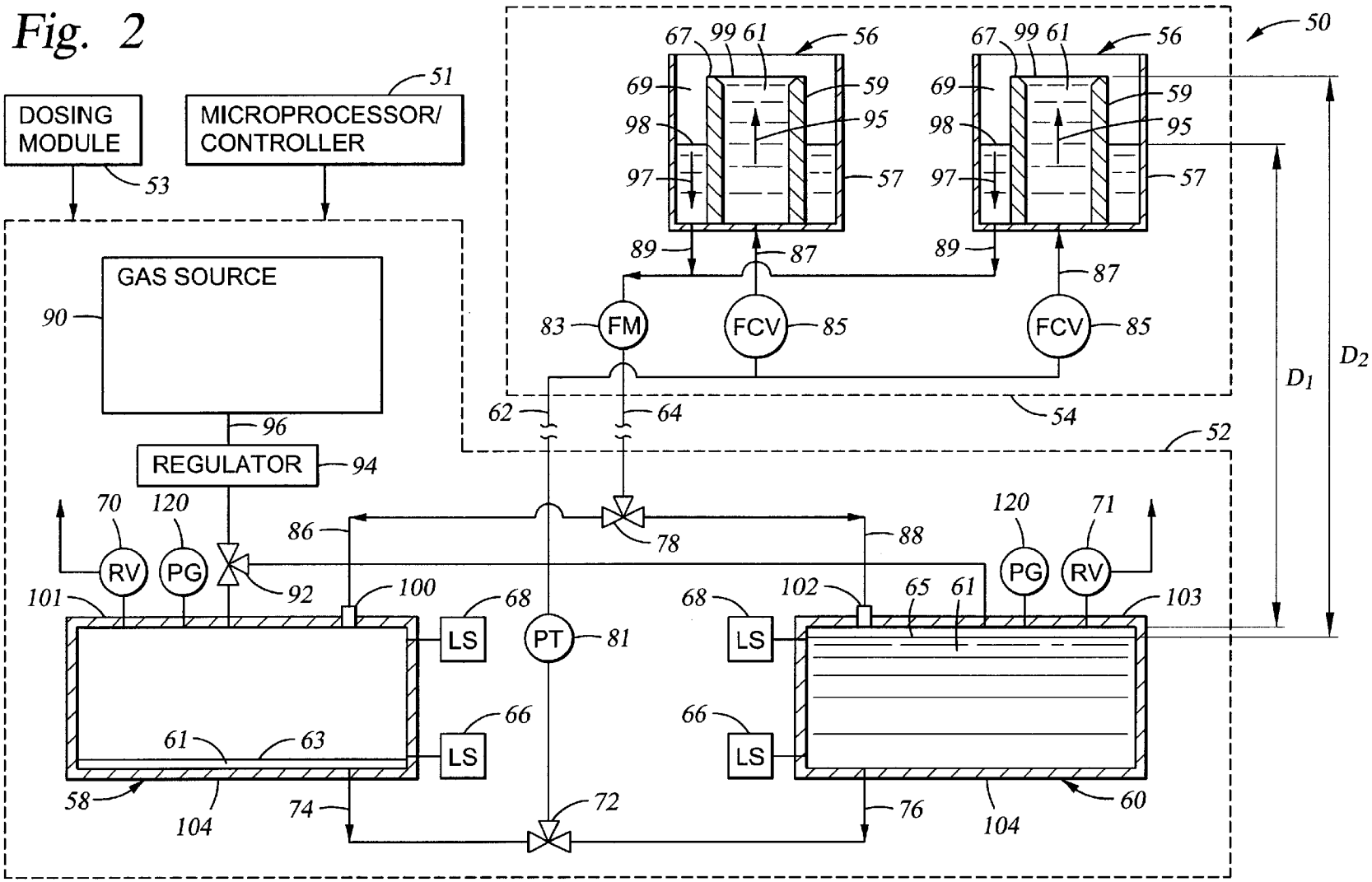
FIG. 2 is a schematic representation of one embodiment of the fluid delivery system of the present invention showing a first reservoir at a low fluid level and a second reservoir at a high fluid level.

FIG. 2 is a schematic of a fluid delivery system 50 of the present invention. In general, the fluid delivery system 50 comprises a chemical cabinet 52 in fluid communication with a substrate processing system 54 and a dosing module 53 which provides controlled quantities of chemicals to maintain a desired concentration of the chemicals in an electrolytic solution. The substrate processing system 54 is preferably an electroplating platform including one or more processing chambers, including cells 56 (two are shown in FIG. 2). One electroplating platform which may be used to advantage is the Electra™ ECP System available from Applied Materials, Inc., located in Santa Clara, Calif.

The cell 56 shown in FIG. 2 is merely illustrative for purposes of describing the present invention. Other cell designs may incorporate and use to advantage the present invention. The electroplating cell 56 generally comprises a cell body 57 having an opening on the top portion thereof. The cell body 57 is preferably made of an electrically insulative material such as a plastic which does not break down in the presence of plating solutions and is sized and shaped cylindrically in order to accommodate a generally circular substrate at one end thereof. However, other substrate and cell shapes are contemplated. A plating chamber 59 is formed interior to the outer diameter of the cell body 57 to contain an electrolytic solution 61. A fluid inlet line 87 is connected at one end to the bottom portion of the cell body 57 and at another end to a supply line 62 to provide fluid communication between the plating chamber 59 and the chemical cabinet 52 as will be described below. An annular weir 67 is formed at an upper end of the plating chamber 59. The weir 67 is positioned to allow fluid to flow from the plating chamber 59, over the weir 67 and into a return annulus 69 formed between the plating chamber 59 and the outer diameter of the cell body 57. The weir height substantially establishes the greatest height of the electrolyte in the system shown in FIG. 2 as fluid height 99. A fluid outlet line 89 connected at one end to a lower portion of the cell body 57 and at another end to a return line 64, thereby providing fluid communication between the return annulus 69 and the chemical cabinet 52 as described below in more detail. In operation, a lower face of a substrate (not shown) is positioned slightly above the weir 67 to extend the substrate surface slightly into the electrolytic solution 61, thereby allowing the fluid to flow over the lower face of the substrate, over the weir 67 and into the return annulus 69. The return annulus 69 and attendant piping are sufficiently large to accommodate the flows in excess of the fluid flowing over the weir 67, so that fluid will not back up in the return annulus 69. Although not shown, the cell 56 may also include known components to facilitate plating, such an anode member and a cathode member to supply a current path through the electrolytic solution 61 and through a conductive layer formed on the substrate. The result of processing a substrate in the foregoing manner is to form a layer of a desired thickness on the substrate by consuming constituents provided in the electrolytic solution 61.

A microprocessor/controller 51 is connected to the fluid delivery system 50 to operate the various components thereof such as valves, regulators and fluid level sensors. The microprocessor/controller 51 operates the functions of the fluid delivery system 50 to allow for controlled delivery of a fluid between the chemical cabinet 52 and the processing system 54. Preferably, the microprocessor/controller 51 is also connected to the processing system 54 and dosing module 53. However, a separate control system may also be used.

The chemical cabinet 52 includes at least two fluid-tight reservoirs 58, 60 for holding electrolytic solution 61. The reservoirs are preferably of equal dimensions and capacity to accommodate equal volumes of fluid and are made of materials which are relatively impervious to corrosion or attack from the plating solutions, including PVDF, PFA, PTFE or a combination thereof. In one embodiment, the reservoirs 58, 60 each have a capacity of 15 gallons. For illustrative purposes, the electrolytic solution 61 in the first reservoir 58 is shown at a low fluid level 63 and the electrolytic solution 61 in the second reservoir 60 is shown at a high fluid level 65. However, in operation, the fluid level in each reservoir 58, 60 alternates between a low fluid level and a high fluid level, as will be discussed below. Sensors 66, 68 provided on each of the reservoirs 58, 60 monitor the fluid levels therein during operation. One sensor which may be used to advantage is a capacitance-type sensor or a ultrasonic-type sensor both of which are know in the industry. A first sensor 66 monitors and detects the low fluid level 63 (shown in the first reservoir 58) and a second sensor 68 monitors and detects the high fluid level 65 (shown in the second reservoir 60) in each reservoir 58, 60. However, while sensors 66, 68 are preferred, in another embodiment the fluid levels in the reservoirs 58, 60 are calculated according to known values such as the volume of the reservoirs 58, 60 and the flow rate into the reservoirs 58, 60.

A gas source 90 is coupled to each of the first and second reservoirs 58, 60. The gas source 90 selectively provides a compressed gas, such as nitrogen, to the reservoirs 58, 60 to pressurize the reservoirs 58, 60 to a desired pressure. In one embodiment, the pressure may be between 0 psi and 60 psi. However, more generally, the pressure may be any value necessary to overcome the flow resistance for the reservoirs 58, 60 to the cells 56 due to the fluid differential, viscosity and friction. The flow rate and direction of the gas from the gas source 90 is controlled by a valve 92 and a regulator 94 disposed in the gas supply line 96. Each reservoir 58, 60 also includes a relief valve 70, 71 respectively, to selectively communicate the reservoirs 58, 60 with ambient conditions and allow for depressurization. Optionally, the reservoirs 58, 60 are equipped with pressure guages 120 to enable realtime pressure measurements.

The reservoirs 58, 60 are coupled to the cells 56 of the processing system 54 by the supply line 62 and the return line 64, thereby comprising a closed-loop system for circulating the electrolytic solution 61. The direction of fluid flow between the reservoirs 58, 60 and the cells 56 is controlled by selectively activating one or more of a plurality of valves 72, 78 disposed in the supply line 62 and return line 64. A first valve 72 is disposed in the supply line 62 at a tee connection where the supply line 62 splits to connect to the first reservoir 58 and second reservoir 60 via a first outlet line 74 and a second outlet line 76, respectively. Similarly, a second valve 78 is disposed in the return line 64 at a tee where the return line 64 splits to connect to a first inlet port 100 of the first reservoir 58 and a second inlet port 102 of the second reservoir 60 via a first inlet line 86 and a second inlet line 88, respectively. Preferably, the flow rates are monitored and controlled through supply line 62 and the return line 64. Thus, in the embodiment shown in FIG. 2, a pressure transducer (PT) 81 is disposed in the supply line 62 and a flow meter (FM) 83 is disposed in the return line 64. The pressure transducer 81 monitors the pressure level in the supply line 62 and the flow meter 83 monitors the flow rate in the return line 64. The pressure transducer 81 and flow meter 83 are merely illustrative of measurement devices which may be used to advantage and other embodiments may include any combination flow meters and pressure transducers. During operation of this embodiment, the pressure transducer 81 provides information as to the pressure level in the supply line 62 to the regulator 94 via the microprocessor/controller 51. Accordingly, real time adjustments can be made to the gas flow through the gas supply line 96 by the regulator 94 in order to ensure the pressure, and hence the flow rate, in the supply line 62 is maintained at a predetermined level. Additional flow rate control into the cells 56 is provided by a pair of flow control valves 85 which are disposed in inlets lines 87 coupling the fluid supply line 62 to the cells 56. The flow control valves are actively controlled by the microprocessor/controller 51 during processing to ensure equal flow rates in all cells 56. Thus, while the pressure transducer 81 and the regulator 94 act to maintain a desired line pressure in the supply line 62, the flow control valves 81 can be adjusted to equalize, or otherwise control, the flow rate through the inlet lines 87 and into a particular cell 56.

Preferably, the ports 100, 102 are disposed at upper ends 101, 103 of the reservoirs 58, 60, respectively. Such an arrangement allows the reservoirs 58, 60 to be filled to the high fluid level 65 without back filling the inlet lines 86, 88, i.e., without requiring the gas to bubble through the electrolyte as the system is pressurized. It is believed that such bubbling may cause slight pressure and flow spikes. However, it is understood that in another embodiment, the fluid inlet ports 100, 102 are positioned on the reservoirs 58, 60 so that back filling into the inlet lines 86, 88 is allowed. For example, the ports 100, 102 may be positioned at a lower end 104 of the reservoirs 58, 60 as are the outlet lines 74, 76 in FIG. 2. The resulting pressure and flow rate fluctuations may then be compensated for by various methods known in the art, such as by mass flow controllers disposed in the supply line 62 and/or return line 64.

As shown in FIG. 2, the fluid levels 65, 98 in the cells 56 and the reservoirs 58, 60, respectively are preferably at least vertically displaced from one another by a height $D_1$. As used herein, height $D_1$ is defined as the distance between the ports 100, 102 and the fluid level 98 in the return annulus 69 of the cells 56. The height $D_1$ enables gravity-assisted fluid flow to facilitate fluid flow from the cells 56 to the reservoirs 58, 60. By "gravity-assisted" is meant that the height $D_1$ provides a positive pressure differential ($\Delta P_1$) between the cells 56 and the reservoirs 58, 60 along the return line 64. Such a pressure differential ($_{\Delta P1}$) is maintained (although it decreases as $D_1$ decreases) so long as the fluid level 98 is maintained at a height $D_1$ higher than the high fluid level 65 (shown in the second reservoir 60 in FIG. 2) in the particular reservoir 58, 60 with which the cells 56 are being communicated with during operation. However, as shown in the embodiment of FIG. 2, the bottom of the cells 56 is preferably higher than the ports 100, 102, thereby allowing the cells 56 to completely drain to the reservoirs 58, 60 if desired. The pressure differential ($\Delta P_1$) and flow rate through the return line 64 can be controlled by adjusting the height $D_1$, sizing the diameter of the return line 64 and accounting for losses due to bends in the return line 64, fluid viscosity and friction. The pressure differential ($\Delta P_1$) is based on fluid and line/tubing characteristics which include the density and viscosity of the fluid, the flow rate of the fluid line/tubing diameter and the roughness of the line/tubing wall. The fluid flow is characterized by its Reynolds Number, a dimensionless number, which depends on the flow rate, density of the fluid, inner diameter of the tubing, and the velocity of the fluid. The Reynolds Number indicates whether the fluid flow is laminar or turbulent. The amount of friction a fluid develops is dynamic and depends on its flow rate for a given size of line/tubing. Disregarding viscosity and friction of the fluid, the pressure differential ($\Delta P_1$) can be described according to Equation 1:

$$\Delta P_1 = \tfrac{1}{2}\rho v_2^2 - \tfrac{1}{2}\rho v_1^2 + \rho g D_1 \qquad \text{Equation 1:}$$

where $\rho$ is the density of the electrolytic solution 61, g=equals the acceleration of the electrolytic solution 61 due to gravity (9.8 m/s$^2$), $v_2$ is the fluid velocity in the return annulus 69 at the height $D_1$ above the ports 100, 102, and $v_1$ is the fluid velocity at the ports 100, 102. Note that when $v_1$ and $v_2$ are small, the pressure differential is essentially given by $\rho g D_1$ (hydrostatic pressure).

The volume flow rate R (having SI units $m^3/s$) at the ports 100, 102 can be described by Equation 2:

$$R=A_1 v v_1=A_2 v_2 \qquad \text{Equation 2:}$$

where $A_1$ is the cross-sectional area of the ports 100, 102, at which point the fluid velocity is $v_1$ and where $A_2$ is the cross-sectional area of the return annulus 69 at which point the fluid velocity is $v_2$ at height $D_1$. In any event, the return line 64 must be sized and configured so that the returning electrolyte does not back up in the return annulus 69 to the height of the weir 67.

FIG. 2 also shows a height $D_2$ defined as the vertical distance between the fluid level 99 in the plating chamber 59 and the fluid level in the reservoir 58, 60 being emptied. Thus, $D_2$ is an increasing value as the fluid level in the reservoirs 58, 60 decreases. During operation, the gas pressure in the reservoir 58, 60 being emptied must at least be greater than the hydrostatic pressure ($\Delta P_2$), given by $\rho g D_2$, as well as the flow resistance due to fluid viscosity and friction to enable fluid flow to the cells 56. Because $D_2$ and $\Delta P_2$ increase in during a plating cycle the gas pressure in the reservoir 58, 60 being emptied must be increased to maintain constant flow in the plating chamber 59.

The dosing module 53 shown in FIG. 2 is coupled to the chemical cabinet 52 to selectively deliver various chemicals to the first and second reservoirs 58, 60. Although not shown in FIGS. 2-3, the dosing module 53 may be connected to each of the reservoirs 58, 60 by conventional coupling devices such as supply lines. Preferably, flow meters (not shown) are used to measure and regulate the flow of fluids from the dosing module 53 to the reservoirs 58, 60. During processing, the chemical constituents of the electrolytic solution 61 are depleted. As a result, the electrolytic solution 61 must be replenished with appropriate proportions of the chemical constituents. Accordingly, the dosing module 53 periodically receives signals from the microprocessor/ controller 51 instructing the dosing module 53 to flow the required chemicals to the first and/or second reservoirs 58, 60. Although not shown in FIGS. 2 or 3, various other components known in the industry may be used to advantage with the present invention, such as filtration devices to purify the electrolytic solution 61.

Figure 3:
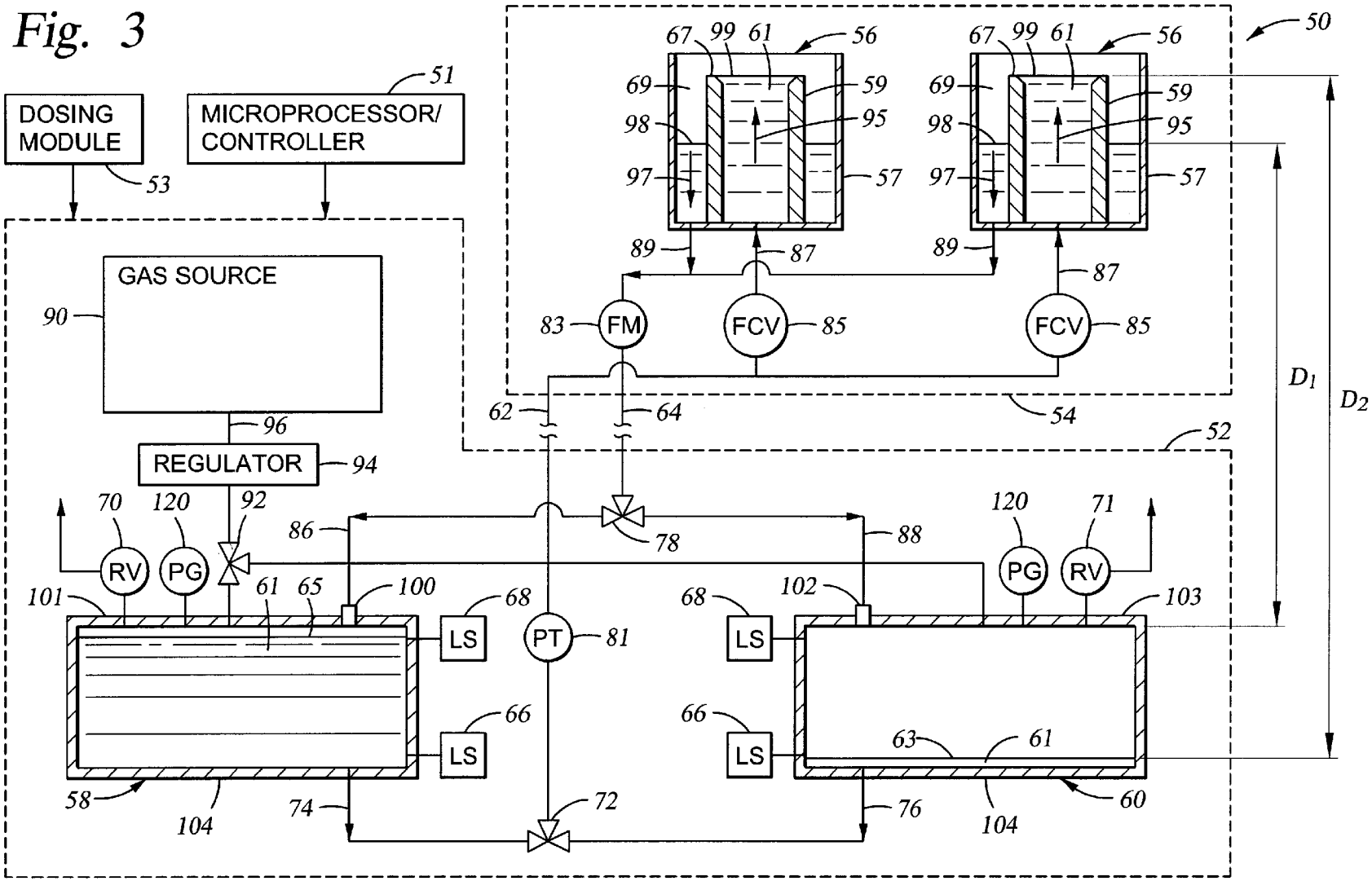
FIG. 3 is a schematic representation of the fluid delivery system of FIG. 2 showing the first reservoir at a high fluid level and the second reservoir at a low fluid level.

In operation, the first and second reservoirs 58, 60 are alternately filled and emptied relative to one another at substantially constant rates, thereby maintaining the flow rate in the cells 56 substantially constant. The operation of the present invention may be illustrated by reference to FIGS. 2–3. FIG. 2 shows an initial state of the fluid delivery system 50 wherein the electrolytic solution 61 in the first reservoir 58 is at a low fluid level 63 and the electrolytic solution 61 in the second reservoir 60 is at a high fluid level 65 and the fluid level in the cells 56 is at the processing fluid level 98. Initially, the second reservoir 60 is pressurized with a gas from the gas source 90 by opening valve 92 to a position communicating the gas source 90 and the second reservoir 60. The regulator 94 is operated by the microprocessor/controller 51 to pressurize the second reservoir 60 to a desired pressure. The reservoirs 58, 60 may be equipped with pressure gauges 120, as shown in FIGS. 2–3, to monitor the pressure in the reservoirs 58, 60. Upon establishing the desired pressure in the second reservoir 60, valve 72 is opened to a first position to allow fluid flow from the second reservoir 60 to the cells 56 through the supply line 62. Simultaneously with opening valve 72, the valve 78 is opened to a first position wherein the first reservoir 58 is communicated with the cells 56 via the return line 64.

The foregoing sequence establishes fluid flow to the cells 56 via the supply line 62 and the fluid inlets 87 and results in fluid flow through the plating chamber 59 as indicated by arrows 95. The fluid flow rate through the supply line 62 to the cells 56 is controlled by adjusting the pressure in the second reservoir 60. Gas pressure is maintained at a level in the second reservoir 60 sufficient to ensure a desired flow rate over the weir 67 of the plating chamber 59 taking into account the total head pressure of the fluid between the reservoir 60 and plating chamber 59 as well as the total frictional losses in the supply line 62 and plating chamber 59. As stated above, as the reservoir 60 drains, the gas volume therein will increase as will $D_2$ and $\Delta P_2$ (the pressure from the top of the liquid in the reservoir 60 to the fluid level 99). Unless the gas pressure in the reservoir 60 is increased to overcome these changes, the flow rate through the supply line 62 and the plating chamber 59 will be reduced. Thus, feedback provided by the pressure transducer 81 is utilized by the microprocessor/controller 51 to adjust the regulator 94 until the desired line pressure is reached. Throughout the processing cycle the pressure in the reservoir 60, and the line pressure, may be adjusted so that the fluid flow in the plating chamber 59 is constant. Additionally, the flow rate into the reservoirs 59 via the inlet line 87 is controlled by the flow control valves 85. By adjusting the control valves 85, the flow into each plating chamber 59 may be kept equal.

The electrolytic solution 61 is then flowed over the weir 67 and into the return annulus 69. From the return annulus 69 the fluid is flowed, in the direction shown by arrow 97, to the outlet line 89. Finally, the fluid is flowed to the first reservoir 58 via the return line 64 and the inlet line 86. The return flow rate from the cell 56 to the first reservoir 58 is determined primarily by the total system head pressure due to the fluid level 98 and the diameter and length of return line 64. Preferably, the head pressure (determined in part by $D_1$) and the return line 64 dimensions are adjusted to ensure that the rate at which the first reservoir 58 is filled is substantially equal to the rate at which the second reservoir 60 is emptied. If needed, additional methods or devices may be employed to further control the return fluid flow. For example, a throttle valve may be used to limit the return flow to the first reservoir 58 (as well as the second reservoir 60 upon reversing the flow as described below with reference to FIG. 3). However, as the return flow is from the base of the return annulus 69 downstream of the weir 67, faster return to the reservoirs 58, 60 is not normally an issue so long as the return lines are properly sized.

Upon reaching a high fluid level 65 in the first reservoir 58 and a low fluid level 63 in the second reservoir 60, as shown in FIG. 3, the second sensor 68 of the first reservoir 58 and the first sensor 66 of the second reservoir 60 transmit a signal to the microprocessor/ controller 51 indicating the fluid levels in the reservoirs 58, 60. The microprocessor/ controller 51 responds by operating the valve 92 to isolate the second reservoir 60 from the gas source 90 and by opening the relief valve 71 to atmosphere to allow depressurization of the second reservoir 60. Valve 92 is then actuated to communicate the gas source 90 and the first reservoir 58. Once the first reservoir 58 is pressurized to a desired pressure, the first reservoir 58 is communicated with the cells 56 via the outlet line 74 by opening valve 72 to a second position to deliver the electrolytic solution 61 to the cells 56 through the supply line 62. Further, the valve 78 is opened to a second position which isolates the first reservoir 58 from the cells 56 and communicates the second reservoir 60 with the cells 56 via the return line 64. The fluid flow rate through the supply line 62 is controlled by adjusting the pressure in the first chamber 58 using feedback provided from the pressure transducer 81 in a manner described with reference to FIG. 2. Further, while the pressure transducer 81 and the regulator 94 cooperate to maintain a desired pressure in the supply line 62, the flow control valves 87 control the flow rate into the respective cells 56.

The steps during each cycle are preferably performed substantially simultaneously, or as close to simultaneously as possible, to ensure the flow rate through the cells 56 is substantially constant and uniform. Most preferably the fluid flow from the reservoirs 58, 60 is alternated during the time that substrates are exchanged from the cells 56, i.e., during a time when the system is necessarily halted and no substrate is being processed. Thus, in one embodiment the volume of fluid in the reservoir 58, 60 being emptied may be sufficient for a single substrate plating cycle. In such an embodiment, the low fluid sensor 66 detects the low fluid level 63 concurrently with the end of a plating cycle. Simultaneous performance of the steps also minimizes overhead time during which fluid flow through the supply line 62 and return line 64 is halted.

Thus, the fluid delivery system 50 comprises a system wherein the total volume of electrolytic solution 61 is maintained constant (subject to evaporative and plating losses as well as losses resulting from substrate removal from the cell 56 subsequent to a plating cycle) and is flowed alternately between the reservoirs 58, 60 to the cells 56. The fluid flow into and out of the cells 56 is kept substantially equal, by adjusting the pressure in the supply line 62 and by controlling fluid flow with valves. Thus, a constant processing fluid flow rate is maintained in the cells and a controlled exchange of the electrolytic solution 61 is maintained between the cells 56 and the reservoirs 58, 60, thereby maintaining a constant processing fluid flow rate in the cells 56 and a controlled exchange of the electrolytic solution 61 between the cells 56 and the reservoirs 58, 60. As noted above, by adjusting the gas pressure in the reservoir 58, 60 being emptied, the flow of the electrolytic solution 61 through the plating chamber 59 can be maintained at a desired rate so that plating uniformity on a substrate is achieved.

Further, because the invention eliminates the use of pumps, flow surges or pulses are avoided. As a result, the fluid flow through the cell 56 and onto the substrates during processing is uniform, thereby resulting in uniform and conformal plating. Various additional methods can be used to further minimize surging which may result during the reservoir switching sequence described above with reference to FIGS. 2–3. For example, the flow control valves 85 may be operated to the ramp the fluid flow up to a stabilized, desired flow rate and then maintaining the fluid flow rate for the duration of the cycle.

It is understood that the particular arrangement, or architecture, of the invention is not to be considered limiting of its scope. FIG. 2 merely shows one possible embodiment. In another embodiment, the processing system 54 and the chemical cabinet 52 are located in separate rooms. Thus, the processing system 54 may be part of a fab located in a clean room environment on one floor of a building while the chemical cabinet 52 is located below the processing system 54 on a lower floor of the building, such as in a basement for example. Such a configuration eliminates traffic through the fab and allows more efficient and safer handling of the chemicals contained in the chemical cabinet 52.

Figure 4:
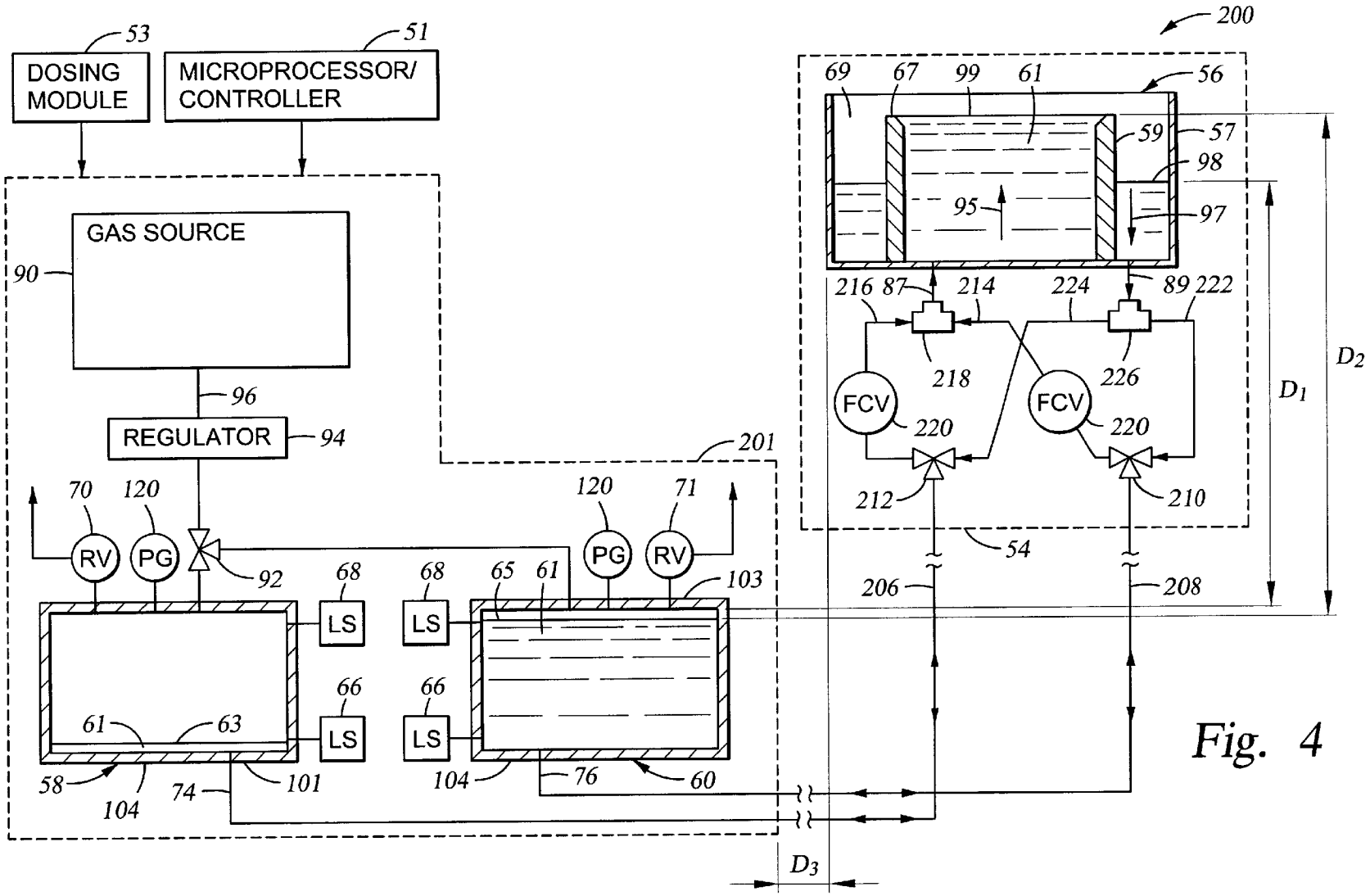
FIG. 4 is a schematic representation of another embodiment of a fluid delivery system.

Another embodiment of a fluid delivery system 200 is shown in FIG. 4. For convenience, like numerals are used to designate components previously described with reference to FIGS. 2–3. Additionally, only one cell 56 is shown but it is understood that more than one cell be used to advantage. A horizontal distance $D_3$ and a vertical height $D_1$ separate the cell 56 and a chemical cabinet 201, where $D_1$ facilitates the gravity-assisted feed described above with reference to FIGS. 2–3. A pair of two-way lines 206, 208 are provided to accommodate fluid flow to and from the chemical cabinet 201. Three-way valves 210, 212 are disposed in each two-way line 206, 208 to direct the electrolytic solution 61 to the appropriate cell 56. Inlet lines 214, 216 are coupled at one end to each of the valves 210, 212, respectively, and at a second end to an inlet tee 218. Preferably, each of the inlet lines 214, 216 has a flow control valve 220 disposed therein. Outlet lines 222, 224 are coupled at one end to an outlet tee 226 and at a second end to each of the valves 210, 212 respectively. The tees 218, 226 are each coupled to the inlet line 87 and the outlet line 89, respectively. The valves 210, 212 are operated such that in a first position fluid flow is allowed from the cell 56 to the chemical cabinet 201 and in the second position fluid flow is allowed from the chemical cabinet 201 to the cell 56.

Operation of the invention is initiated by pressurizing one of the two reservoirs 58, 60 to a pressure sufficient to overcome the hydrostatic pressure, $\rho g D_2$, and the flow resistance resulting from fluid viscosity and line friction. Accordingly, valve 92 may be opened to a position communicating the gas source 90 with the first reservoir 58. Upon reaching a desired pressure, which may be monitored by the pressure gauges 120, valve 212 is actuated to a position allowing fluid flow from two-way line 206 into the cell 56 via the inlet line 216 and tee 218. Simultaneously, valve 210 is opened to a position allowing fluid flow from the cell 56, through the tee 226 and outlet line 222, and into the two-way line 208. Thus, electrolytic solution 61 is supplied from the chemical cabinet 201 along two-way line 206 and returned from the cell 56 along two-way line 208. Once the fluid level in the first reservoir 58 reaches a desired lower limit, as detected by the fluid level sensor 66, the direction of flow through lines 206, 208 may be reversed. Thus, the first reservoir 58 is vented through relief valve 70 and valve 92 is positioned to communicate gas source 90 with the second reservoir 60. Simultaneously, valve 212 is actuated to allow fluid flow from cell 56 through the tee 226, along the outlet line 224, through valve 212, and into two-way line 206. Further, valve 210 is actuated to allow fluid flow from two-way line 208, through valve 210, inlet line 214 and tee 218, and into the cell 56.

The flow rates through the inlet lines 214, 216 are controlled by flow control valves 220. Additionally, the line pressure in the two-way lines 206, 208 can be determined by adjusting the pressure in the chambers 58, 60 using the regulator 94. Other methods and devices may be used to further control the fluid flow. For example, during each cycle, the reservoir 58, 60 being filled may be kept at a pressurized state rather than being vented to ambient conditions via relief valves 70, 71 and returned to atmospheric pressure. Thus, in one embodiment, the relief valves 70, 71 may be controlled to restrict airflow into the reservoir 58, 60 being filled during each cycle. In this manner, the return flow rate from the cell 56 back to the chemical cabinet 201 can be slowed to a desired rate as a function of the reservoir pressure. Alternatively or additionally, the valve 92 can be adapted to communicate both reservoirs 58, 60 simultaneously with the gas source 90, thereby allowing each to be pressurized to a desired pressure independently. As a result the flow rates to and from the chemical cabinet 201 are controlled by regulating the pressure in the reservoirs 58, 60. Such an arrangement is particularly useful in the embodiment of FIG. 4 where a single line, i.e., lines 206, 208, is used to accommodate two-way fluid flow. This is a result of being restricted to a particular line diameter for both directions of flow. In contrast, the embodiment of FIG. 2 provides the flexibility of utilizing different diameters for the supply line 62 and the return line 64 in order to compensate for flow rate variations.

Thus, the embodiment of FIG. 4 utilizes two-way flow through a pair of lines 206, 208, thereby obviating the need for separate inlet lines 86, 88 and outlet lines 74, 76 as was used in the embodiment of FIG. 2. Thus, the total length of tubing needed for can be minimized because a single line accommodates flow in two directions. Further, while the return flow to the reservoirs 58, 60 in the embodiment of FIGS. 2–3 is at an upper end of the reservoirs 58, 60, the embodiment of FIG. 4 illustrates a connection point at the bottom of the reservoirs 58, 60 for the fluid lines. The embodiments of FIGS. 2–4 are merely illustrative of the invention. Persons skilled in the art will recognize other embodiments.

Computer Control

The processes described above can be implemented using a computer program product. For simplicity, operation of the program product will be described only with reference to the embodiment of FIGS. 2–3 but it is understood that the same, or similar, program product can be used in other embodiments, including those of FIG. 4.

Preferably the program product runs on a conventional computer system comprising a central processor unit (CPU) connected to a memory system with peripheral control components, such as for example a 68400 microprocessor, 10 commercially available from Synenergy Microsystems, Calif. In the foregoing descriptions the computer system is shown as the microprocessor/controller 51, described with reference to FIG. 2. The computer program code can be written in any conventional computer readable programming language such as for example 68000 assembly language, C, C++, Pascal or Java. Suitable program code is entered into a single file, or multiple files, using a conventional text editor, and stored or embodied in a computer usable medium, such as a memory system of the computer. If the entered code text is in a high level language, the code is compiled, and the resultant compiler code is then linked with an object code of precompiled windows library routines. To execute the linked compiled object code, the system user invokes the object code, causing the computer system to load the code in memory from which the CPU reads and executes the code to perform the tasks identified in the program.

A fluid control subroutine has program code for controlling electrolytic solution 61 flow rates. Generally, the supply line 62 and return line 64 comprise one or more components that can be used to measure and control the flow of the fluid from the reservoirs 58, 60 to the cells 56. FIGS. 2–3, for example, include flow control valves 85 and valves 72, 78. The fluid control subroutine ramps up/down the flow control valves 85 to obtain the desired fluid flow rates into the cells 56. The fluid control subroutine is invoked by a manager subroutine, as are all system component subroutines, and receives from the manager subroutine parameters related to the desired fluid flow rates. Typically, the fluid control subroutine operates by selectively opening the valves 72 and 78, and repeatedly (i) reading the flow rates from flow control valves 85 (ii) comparing the readings to the desired flow rates received from the manager subroutine, and (iii) adjusting the flow rates as necessary. Furthermore, the fluid control subroutine includes steps for monitoring the fluid flow rates for unsafe rates and activating valves 72, 78 accordingly when an unsafe condition is detected.

The flow rate of the electrolytic solution 61 from the reservoirs 58, 60 is also determined by the pressure supplied to the reservoirs 58, 60 from the gas source 90. When a pressure control subroutine is invoked, the desired or target pressure level to be attained in the reservoirs 58, 60 is received as a parameter from the manager subroutine. The pressure control subroutine operates to actuate the valve 92 to a desired position allowing pressurization of one of the reservoirs 58, 60. The pressure control subroutine also measures the pressure in the supply line 62 via the pressure transducer 81, compares the measured value to the target pressure, obtains PID (proportional, integral, and differential) values from a stored pressure table corresponding to the target pressure, and adjusts the regulator 94 according to the PID values obtained from the pressure table. Where the reservoirs 58, 60 are equipped with one or more conventional pressure manometers, a similar method may be used to measure the pressure of the reservoirs 58, 60.

A fluid level subroutine is invoked to determine the fluid level in the reservoirs 58, 60 being monitored by the sensors 66, 68. The fluid control subroutine is invoked by the manager subroutine and monitors the output states of the sensors 66, 68 which are switched depending on the level of the fluid in the reservoirs 58, 60. A change in the output states of the sensors 66, 68 is transmitted to the microprocessor/controller 51 which then invokes the proper subroutine(s) to reverse the flow of fluid. The proper subroutines include the fluid flow subroutine and the pressure control subroutine, described above, as well as a relief valve subroutine which operates to open or close the relief valves 70, 71. Other possible system architectures may be used by those skilled in the art.

While the foregoing is directed to the preferred embodiment of the present invention, other and further embodiments of the invention may be devised without departing from the basic scope thereof, and the scope thereof is determined by the claims that follow.

What is claimed is:

1. An apparatus, comprising:

(a) at least a first reservoir and a second reservoir;

(b) a substrate processing system at least vertically displaced from the first and second reservoirs by a height;

(c) a pressure source in selective communication with the first and second reservoirs to selectively establish a desired gas pressure to the reservoirs to alternately enable fluid flow from one of the reservoirs to the substrate processing system;

(d) a first connection line connecting the first and second reservoirs to the substrate processing system to accommodate fluid flow in at least a first direction; and (e) a second connection line connecting the first and second reservoirs to the substrate processing system to accommodate fluid flow in at least a second direction.

2. The apparatus of claim 1, wherein the substrate processing system comprises one or more electroplating reservoirs.

3. The apparatus of claim 1, further comprising:

(f) a first valve disposed in the first connection line to selectively communicate one of the first or second reservoirs with the substrate processing system while isolating the other of the first or second reservoirs from the substrate processing system; and (g) a second valve disposed in the second connection line to selectively communicate one of the first or second reservoirs with the substrate processing system while isolating the other of the first or second reservoirs from the substrate processing system.

4. The apparatus of claim 3, further comprising a controller configured to inversely control the position of the first and second valves so that when the first valve is positioned to communicate one of the first and second reservoirs with the substrate processing system the second valve is positioned to communicate the substrate processing system with the other of the first and second reservoirs.

5. The apparatus of claim 1, wherein the first and second reservoirs each comprise:

(f) a first sensor to monitor a low fluid level; and (g) a second sensor to monitor a high fluid level.

6. The apparatus of claim 1, wherein the first and second reservoirs include relief valves to selectively communicate the first and second reservoirs with ambient conditions.

7. The apparatus of claim 1, further comprising one or more flow meters disposed in at least one of the first connection line and the second connection line to monitor fluid flow therethrough.

8. An electroplating fluid delivery system, comprising:

(a) at least a first reservoir and a second reservoir;

(b) an electroplating system fluidly connected to the first and second reservoirs by a supply line to accommodate fluid flow from the first and second reservoirs to the electroplating system and a return line to accommodate fluid flow from the electroplating system to the first and second reservoirs;

(c) a pressure source connected to the first and second reservoirs to selectively pressurize the reservoirs and enable fluid flow through the supply line and to the electroplating system;

(d) at least one valve disposed in each of the supply line and the return line to selectively communicate one of the first or second reservoirs with the supply line while communicating the other of the first or second reservoirs with the return line; and (e) a valve disposed in the return line to selectively communicate one of the first or second reservoirs with the electroplating system while isolating the other of the first or second reservoirs from the electroplating system;

wherein the electroplating system is at least vertically displaced from the first and second reservoirs by a vertical distance to allow gravity-assisted fluid flow from the electroplating system to the first and second reservoirs.

9. The system of claim 8, wherein the first and second reservoirs include a relief valve to selectively communicate the first and second reservoirs with ambient conditions.

10. The system of claim 8, wherein the first and second reservoirs each comprise:

(f) a first sensor to monitor a low fluid level; and (g) a second sensor to monitor a high fluid level.

11. The system of claim 8, further comprising one or more flow meters disposed in at least one of the supply line and the return line to monitor fluid flow therethrough.

12. A method for delivering a fluid between a pair of reservoirs and a substrate processing system wherein a first fluid level in the substrate processing system is maintained at a level higher than a second fluid level in the pair of reservoirs to provide a positive fluid pressure differential between the substrate processing system and the pair of reservoirs, the method comprising:

(a) pressurizing a first reservoir and flowing fluid at a first rate from the first reservoir into the substrate processing system;

(b) flowing fluid at a second rate from the substrate processing system into a second reservoir by utilizing the positive fluid pressure differential; and (c) reversing the fluid flow to provide fluid flow from the second reservoir to the substrate processing system and from the substrate processing system to the first reservoir.

13. The method of claim 12, wherein pressurizing the first reservoir comprises supplying a gas to the first reservoir.

14. The method of claim 12, wherein (a) and (b) are performed substantially simultaneously.

15. The method of claim 12, wherein (a) comprises supplying a gas to the first reservoir and opening a first valve disposed in a supply line connecting the first reservoir and the substrate processing system and (b) comprises opening a second valve disposed in a return line connecting the second reservoir and the substrate processing system.

16. The method of claim 12, wherein the first fluid level is maintained at a processing level.

17. The method of claim 12, wherein the first fluid level is maintained at a processing level and the second fluid level is alternated between a high fluid level and a low fluid level.

18. The method of claim 17, wherein the first reservoir and the second reservoir are inversely alternated between the high fluid level and the low fluid level so that one of the first or second reservoirs is at the high fluid level when the other reservoir is at the low fluid level.

19. The method of claim 12, wherein (c) comprises:

(d) ceasing fluid flow from the first reservoir to the substrate processing system;

(e) ceasing fluid flow from the substrate processing system to the second reservoir;

(f) pressurizing the second reservoir and flowing fluid at a third rate from the second reservoir into the substrate processing system; and (g) flowing fluid at a fourth rate from the substrate processing system into the first chamber by utilizing the positive fluid pressure differential.

20. The method of claim 19, further comprising:

(h) ceasing fluid flow from the second reservoir to the substrate processing system;

(i) ceasing fluid flow from the substrate processing system to the first reservoir; and (j) repeating (a)–(f).

21. The method of claim 19, wherein pressurizing the first reservoir and pressurizing the second reservoir comprises supplying a gas to the first reservoir and second reservoir, respectively.

22. The method of claim 19, wherein (a) and (b) are performed substantially simultaneously and wherein (d) and (e) are performed substantially simultaneously and (f) and (g) are performed substantially simultaneously.

23. The method of claim 19, wherein (a) comprises opening a first valve to a first position to communicate the first reservoir with the substrate processing system, (b) comprises opening a second valve to a first position to communicate the substrate processing system with the second reservoir, (f) comprises opening the first valve to a second position to communicate the second reservoir with the substrate processing system, and (g) comprises opening the second valve to a second position to communicate the substrate processing system with the first chamber.

24. The method of claim 19, wherein the second fluid level is maintained between a high fluid level and a low fluid level and wherein (a) and (b) are performed upon reaching the high fluid level in the first reservoir and the low fluid level in the second reservoir and wherein (f) and (g) are performed upon reaching the low fluid level in the first reservoir and the high fluid level in the second reservoir.

* * * * *

UNITED STATES PATENT AND TRADEMARK OFFICE

CERTIFICATE OF CORRECTION

PATENT NO. : 6,299,753 B1
DATED : October 9, 2001
INVENTOR(S) : Chao et al.

It is certified that error appears in the above-identified patent and that said Letters Patent is hereby corrected as shown below:

Column 1,
Line 5, please delete "b".

Column 5,
Line 31, please replace "guages" with -- gauges --.

Column 6,
Line 36, please replace "($_{\Delta P1}$)" with -- ($\Delta P_1$) --.

Column 7,
Line 8, please replace "$vv_1$" with -- $v_1$ --.

Column 11,
Line 21, please start new paragraph after "lines".
Line 37, please delete "10".

Column 14,
Line 48, please replace "20", with -- 20. --.

Signed and Sealed this

Twenty-seventh Day of August, 2002

*Attest:*

*Attesting Officer*

JAMES E. ROGAN
*Director of the United States Patent and Trademark Office*